United States Patent [19]

Fikentscher et al.

[11] Patent Number: 4,704,132

[45] **Date of Patent: * Nov. 3, 1987**

[54] AFTER-TREATMENT OF DYEINGS WITH REACTIVE DYES ON CELLULOSE FIBER MATERIALS

[75] Inventors: Rolf Fikentscher; Sigismund Heimann, both of Ludwigshafen; Heinrich Mertens, Frankenthal; Siegfried Schneider, Ludwigshafen; Michele Vescia, Limburgerhof, all of Fed. Rep. of Germany

[73] Assignee: BASF Aktiengesellschaft, Ludwigshafen, Fed. Rep. of Germany

[ * ] Notice: The portion of the term of this patent subsequent to Jun. 3, 2003 has been disclaimed.

[21] Appl. No.: 886,319

[22] Filed: Jul. 17, 1986

[30] Foreign Application Priority Data

Jul. 22, 1985 [DE] Fed. Rep. of Germany ..... 3526101

[51] Int. Cl.[4] ..... D06M 13/34

[52] U.S. Cl. ..... 8/189; 8/181

[58] Field of Search ..... 8/189, 567, 554, 606, 8/680, 97, 924, 128 A, 181

[56] References Cited

U.S. PATENT DOCUMENTS 4,592,757 6/1986 Fikentscher et al. ..... 8/128 A 4,592,758 6/1986 Fikentscher et al. ..... 8/127.6

FOREIGN PATENT DOCUMENTS 2006279 5/1979 United Kingdom .

*Primary Examiner*—Paul Lieberman

*Assistant Examiner*—John F. McNally

*Attorney, Agent, or Firm*—Oblon, Fisher, Spivak, McClelland, & Maier

[57] ABSTRACT

Dyeings with reactive dyes on cellulose fiber materials are after-treated with an aqueous solution of a condensate which is obtainable by reacting (a) bisbenzylpiperzine with (b) ethylene chloride, an epihalohydrin, propylene chloride, 1,3-dichloro-2-hydroxypropane, bisepoxybutane or 1,4-dichlorobutane or a mixture of these, in a molar ratio of from 1:0.5 to 1:1.1, or by reacting (c) piperazine, bis-1,4-aminopropylpiperazine, 1-aminoethylpiperazine, 2-hydroxyethylpiperazine or 1-methylpiperazine, or a mixture of these, with a compound according to (b) in a molar ratio of from 1:0.5 to 1:1.1 and benzylating the condensate, the benzylation being carried out using 0.15–1.0 mole of benzyl chloride per equivalent of nitrogen in component (c). The cellulose fiber materials after-treated in this manner possess very good wetfastness.

4 Claims, No Drawings

AFTER-TREATMENT OF DYEINGS WITH REACTIVE DYES ON CELLULOSE FIBER MATERIALS

German Laid-Open Application DOS No. 2,747,358 discloses that dyeings with reactive dyes on cellulose fiber materials can be after-treated with aqueous solutions of condensates of polyamines and epichlorohydrin at a pH of the aqueous solution of from 3.5 to 11 and at, preferably, from 65° to 100° C. The amounts of cationic condensates used are from 0.5 to 4% by weight, based on the dry weight of the dyed goods. Such a treatment can be used to improve the wetfastness of reactive dyes on cellulose, but a further improvement in the fastness properties of the after-treated dyeings is desirable.

It is an object of the present invention to provide a process for the after-treatment of dyeings with reactive dyes on cellulose fiber materials, which also gives textile materials which are dyed in deep hues and do not bleed onto an untreated undyed cotton fabric when subjected to a plating test.

We have found that this object is achieved, according to the invention, if the after-treatment agent used is a cationic condensate which is obtainable by reacting (a) bisbenzylpiperazine with (b) ethylene chloride, an epihalohydrin, propylene chloride, 1,3-dichloro-2-hydroxypropane, bisepoxybutane or 1,4-dichlorobutane or a mixture of these, in a molar ratio of from 1:0.5 to 1:1.1, or by reacting (c) piperazine, bis-1,4-aminopropylpiperazine, 1-aminoethylpiperazine, 2-hydroxyethylpiperazine or 1-methylpiperazine, or a mixture of these, with a compound according to (b) in a molar ratio of from 1:0.5 to 1:1.1 and then benzylating the condensate, 0.15–1.0 mole of benzyl chloride being used per equivalent of nitrogen in component (c) for the benzylation.

The cellulose fiber materials can be in the form of fibers, yarns, fabrics or other piece goods and can consist of cotton, linen or rayon staple. The cellulose fiber materials can, if desired, be in the form of a mixture with synthetic fibers, such as nylon, polyacrylonitrile or polyester fibers.

The cellulose fibers are dyed with the commercial reactive dyes in a conventional manner, for example at 20°–100° C. by the exhaust method or at room temperature by the cold pad-batch method. After it has been dyed, the textile material is washed, first with cold water, then twice with hot water (95°–100° C.) and, if required, again with water at 60°–80° C. Only after this has been carried out is the cellulose material dyed with reactive dyes treated, in aqueous solution with the cationic condensate used as the after-treatment agent.

The cationic condensates used according to the invention are obtainable by reacting (a) bisbenzylpiperazine with (b) ethylene chloride, an epihalohydrin, propylene chloride, 1,3-dichloro-2-hydroxypropane, bisepoxybutane or 1,4-dichlorobutane, or a mixture of these, in a molar ratio of a to b of from 1:0.5 to 1:1.1.

They are also obtainable by reacting (c) piperazine, bis-1,4-aminopropylpiperazine, 1-aminoethylpiperazine, 2-hydroxyethylpiperazine or 1-methylpiperazine, or a mixture of these, with the above bifunctional crosslinking agents according to (b) and benzylating these condensates, from 0.15 to 1.0 mole of benzyl chloride being used per equivalent of nitrogen in component (c) for the benzylation.

The condensation of components (a) or (c) with (b) is carried out at a pH of from 6.5 to 12, preferably from 7 to 10, which, where necessary, is established using bases such as sodium hydroxide solution, potassium hydroxide solution, sodium carbonate, calcium oxide, calcium hydroxide, barium oxide or barium hydroxide. Where the compounds of group (a) or (c) are used in excess in the condensation, the basicity of these compounds results in an alkaline pH. The condensation is carried out in aqueous or alcoholic solution at 60°–100° C., the solids content of the solution usually being 20–60% by weight. The alcoholic solvents used are, for example, ethylene glycol, propylene glycol, diglycol and/or neopentyl glycol. In 45% strength aqueous solution at 20° C., the water-soluble condensates which have not yet been quaternized have a viscosity of not less than 500 mPa.s. Effective cationic after-treatment agents are obtained if the cationic condensates, in particular those prepared from piperazine and epichlorohydrin or ethylene chloride, are then quaternized with benzyl chloride.

For the benzylation of the condensates of components (c) and (b), from 0.15 to 1.0, preferably from 0.4 to 0.75, mole of benzyl chloride is used per N equivalent of component (c). This results in benzylation of 15–90% of the tertiary and, where these are present, the secondary nitrogen atoms in the condensate. Condensates possessing secondary and tertiary nitrogen atoms are formed when 1-aminoethylpiperazine or bis-1,4-aminopropylpiperazine is used as the component (c). Benzylation is preferably carried out in an aqueous medium at 60°–100° C. Both the condensation reaction and the benzylation of the condensates can be effected at above 100° C. under superatmospheric pressure. This results in shorter reaction times. The aqueous or alcoholic solution of the benzylated condensate can be used directly as a cationic condensate for the after-treatment. The viscosity of the benzyl-containing cationic condensates is not less than 75, preferably 150–400, mPa.s, measured in 24% strength aqueous solution at 20° C.

The cellulose fiber materials which are dyed with reactive dyes and may be present in the form of a mixture with other fibers are after-treated with an aqueous liquor, batchwise in a dyeing apparatus, continuously in a lisseuse for tops, or on a padding mangle or open-width washing machine for sheet materials. Batchwise after-treatment of the dyed materials with the aqueous liquors generally lasts for from 5 to 30 minutes. The cationic after-treatment agents are employed in an amount of from 0.1 to 5, preferably from 0.2 to 3, % by weight, based on the dry cellulose fiber material. The dyeing with reactive dyes on cellulose fiber materials is washed thoroughly with water and then after-treated with an aqueous solution at from 5° to 120° C., preferably from 30° to 100° C., and at a pH of from 4 to 11, preferably from 5 to 8. The reactive dye removed from the dyed material and in the hydrolyzed form remains in the after-treatment liquor and is not deposited on the dyed and after-treated material. The cellulose fiber materials dyed with reactive dyes and after-treated according to the invention do not show any lightening of color after the treatment according to the invention, so that no changes in hue result even in the case of combination dyeings. Dyeings which meet the stringent requirements set in practice with respect to fastness to water are obtained in this way. After the novel treatment, the cellulose fiber material is washed and then dried. The drying temperature has no significant effect on the improvement in the wetfastness.

In the Examples, parts and percentages are by weight. The viscosities were measured using a rotational viscometer. The following resin solutions were used as cationic condensates:

Condensate 1

496.7 parts of epichlorohydrin were added to 516 parts (6 moles) of piperazine in 644 parts of water in the course of 50 minutes, the reaction temperature being allowed to increase from 50° to 88° C. during this procedure. The reaction mixture was then kept at 90°–95° C. for 4 hours, after which the product had a viscosity of 4,400 mPa.s (20° C.) and a chloride content of 3.25 millimoles/g. 414 parts of water were added and the mixture was cooled to room temperature, the viscosity being 270 mPa.s at 20° C.

3,050 parts of propane-1,2-diol and 1,050 parts of water were added to 1,750 parts of this solution, 400 parts of 50% strength sodium hydroxide solution were introduced, and 882 parts of benzyl chloride were then slowly added at from 60° to 70° C. After a reaction time of 5 hours at 80° C., the clear solution had a chloride content of 1.59 millimoles/g, a pH of 3.9 and a viscosity of 90 mPa.s (20° C.). The content of active ingredient in the solution of condensate 1 was 21.9%, and the viscosity of a 24% strength solution of the condensate was 140 mPa.s at 20° C. 70% of the nitrogen atoms had been quaternized with benzyl chloride, corresponding to 0.7 mole of benzyl chloride per equivalent of nitrogen in the piperazine.

Condensate 2

2,560 Parts of ethylene glycol and 440 parts of 50% strength aqueous sodium hydroxide solution were added to 1,730 parts of the piperazine/epichlorohydrin condensate prepared as described under condensate 1. 882 parts of benzyl chloride were added in the course of 0.5 hour at from 60° to 80° C., after which the mixture was kept at 80° C. for 5 hours. After cooling to room temperature, the clear solution had a pH of 4.3, a chloride content of 2.05 millimoles/g and a viscosity of 285 mPa.s (20° C.). The content of active ingredient, ie. condensate 2, was 27.8%, and the viscosity of a 24% strength solution of the condensate was 220 mPa.s at 20° C. 70% of the nitrogen atoms had been quaternized with benzyl chloride, corresponding to 0.7 mole of benzyl chloride per equivalent of nitrogen in the piperazine.

Condensate 3

The procedure described under condensate 2 was followed, except that, instead of being carried out in ethylene glycol, the benzylation was effected after the addition of the same amount of diethylene glycol to the piperazine/epichlorohydrin condensate. A clear solution of condensate 3 was obtained. The viscosity of a 24% strength solution was 300 mPa.s at 20° C. As in the case of condensate 2, 70% of the nitrogen atoms had been quaternized.

In order to test the wetfastness of the dyeing, a plating test was carried out.

Plating Test

In practice, the end point of an after-washing process is frequently checked for reactive dyeing by placing a piece of the dyed material, prior to drying, between two moistened undyed cotton fabrics and plating this sandwich until it is dry.

As a result of this treatment, the unfixed dyes migrate from the dyed material to the undyed material. The test method is very sensitive since the smallest amounts of unfixed dyes soil the undyed material.

The dyeings were subjected to this plating test. The sandwiches were pressed in the plating machine (Siemens Heimbugler Spezial) for 2×30 seconds at 180° C. and then dried with the machine running.

EXAMPLE 1

In a hank-dyeing apparatus, 80 kg of wet mercerized cotton yarn are dyed in 1,000 l of dye liquor which contains 1.04 kg of the yellow reactive dye of the formula

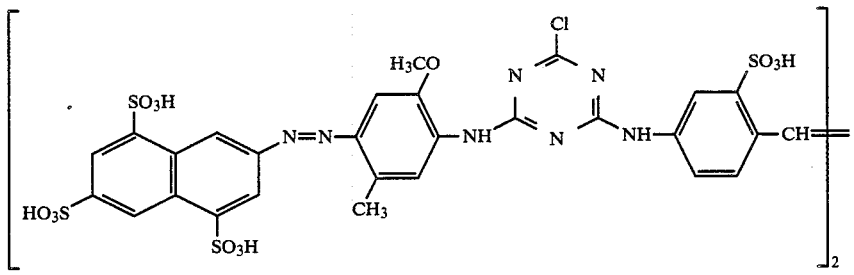

and 1.6 kg of the red reactive dye of the formula

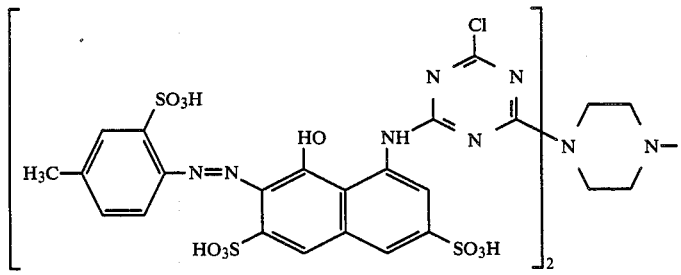

in a commercial formulation, the dyeing procedure being carried out as follows.

The dye bath is heated to 95° C. in the course of 20 minutes. After a residence time of 10 minutes at 95° C., 30 kg of sodium chloride are added and the temperature is then kept at 95° C. for a further 5 minutes. The bath is cooled to 80° C. in the course of 10 minutes, after which 4 kg of sodium carbonate and 2 l of 44.8% strength aqueous sodium hydroxide solution are added.

The dye bath is then kept at 80° C. for a further 30 minutes, after which it is discharged. This is followed by a cold wash for 10 minutes with overflow.

Thereafter, washing is carried out twice for 10 minute periods at 98° C. and once for 10 minutes at 70° C.

The yarn is then divided into 3 parts:

a. One part of the dyed yarn is dried and subjected to the plating test.
b. The second part of the dyed yarn is after-treated for 20 minutes at 40° C. with an aqueous solution which contains 2% of condensate 1 (21.9% strength) and has a pH of about 7.
c. The third part of the dyed yarn is after-treated for 10 minutes at the boil, as described in German Laid-Open Application DOS No. 2,747,358, using an aqueous solution which contains 2% of the condensate obtained from 1 mole of methyldipropylenetriamine and 0.87 mole of epichlorohydrin (21.9% strength) and has a pH of about 7.

The plating test shows that the untreated yarn (sample a) bleeds to a pronounced extent onto the undyed fabric. Although it was possible to reduce bleeding by means of treatment (c), it is not prevented. This is achieved only by treatment (b).

EXAMPLE 2

On a JET dyeing apparatus, 300 kg of cotton knitwear are dyed for 30 minutes at 80° C. in 3,000 l of dye liquor which contains 4.5 kg of the red reactive dye of the formula

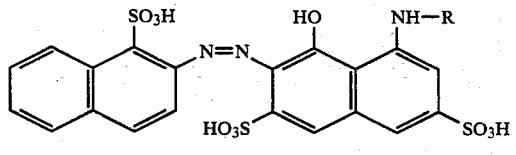

where R is

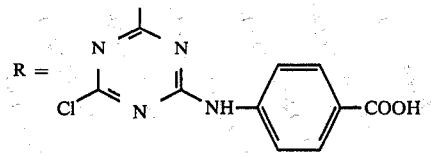

in a commercial formulation,
4.5 kg of sodium m-nitrobenzenesulfonate,
180 kg of sodium chloride and
45 kg of sodium carbonate.

This is followed by a cold wash for 10 minutes, a boiled wash for 2 periods of 10 minutes each, spinning and drying. The cotton knitwear is then treated on a padding mangle with an aqueous solution which contains the following substances:

10 g/l of condensate 2 (27.8% strength),
4 g/l of a cationic softener (condensate obtained from stearic acid and aminoethylethanolamine) and
10 g/l of a $C_{18}$ fatty alcohol oxyethylate containing 80 moles of ethylene oxide.

The wet pick-up is 80%. The knitwear is then dried at 120° C.

The plating test shows that, in contrast to the untreated goods, the knitwear treated in this way does not bleed onto the undyed fabric.

EXAMPLE 3

Dyeing and after-treatment are carried out as described in Example 2, except that the 3,000 liters of dye liquor contain 4.8 kg of the greenish blue dye of the formula

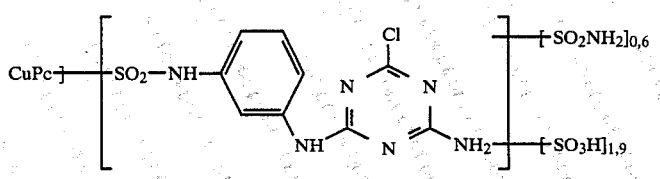

in a commercial formulation. In the plating test, no bleeding onto an undyed calico fabric is observed.

EXAMPLE 4

In an overflow dyeing apparatus, 75 kg of bleached cotton jersey are dyed in 1,200 l of dye liquor which contains 2.475 kg of the yellowish red reactive dye of the formula

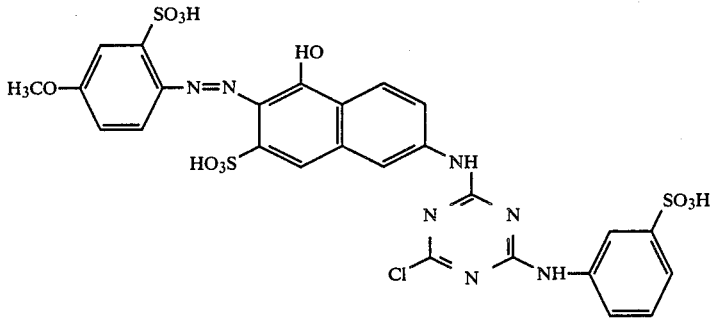

0.99 kg of the red reactive dye of the formula

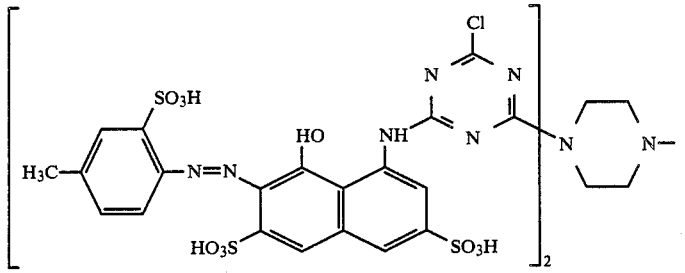

and 0.04 kg of the blue reactive dye of the formula

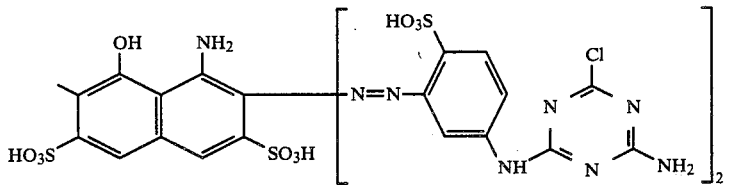

each in a commercial formulation, as well as 20 g/l of sodium carbonate and 80 g/l of sodium chloride, the dyeing procedure being as follows.

Dyeing is first carried out for 15 minutes at 25° C., after which the dye bath is heated to 50° C. in the course of 30 minutes and then kept at this temperature for 20 minutes. It is then heated to 80° C. in the course of 30 minutes, and dyeing is completed in the course of 45 minutes.

A cold wash is carried out for 10 minutes, followed by 2 boiled washes for 10 minutes each and then a wash for 10 minutes at 50° C.

The good are then after-treated for 10 minutes at 60° C. with an aqueous solution which contains 1.5% of condensate 3 (24% strength) and has a pH of about 7. In the subsequent plating test, no bleeding onto an undyed calico fabric is observed.

EXAMPLE 5

Dyeing and washing are carried out as described in Example 4. After-treatment is carried out for 10 minutes at the boil, using an aqueous solution which contains 1.5% of condensate 3 (24% strength) and 1.6% (1 g/l) of calcined sodium carbonate and has a pH of about 10.5.

In the subsequent plating test, no bleeding on to an undyed calico fabric is observed.

EXAMPLE 6

Dyeing is carried out as described in Example 4. The dyed material is then washed three times at 25° C., for 10 minutes in each case, after which it is subjected to one boiled wash for 10 minutes and then after-treated with an aqueous solution which contains 1.5% of condensate 3 and 1.6% of calcined sodium carbonate and has a pH of about 10.5. The after-treatment bath is at 40° C. when the material is introduced, the bath then being heated to the boil in the course of 20 minutes. The plating test shows that cotton jersey treated in this manner does not bleed onto the undyed fabric.

EXAMPLE 7

In an overflow dyeing apparatus, 100 kg of cotton tricot are introduced into 2,000 l of dye liquor which contains 5 kg of the red reactive dye of the formula

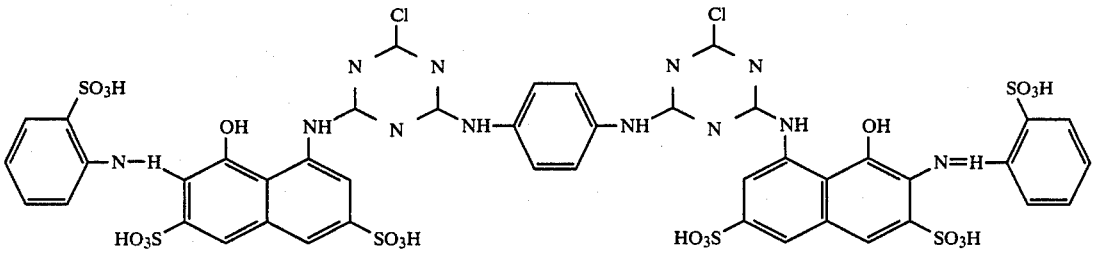

in a commercial formulation, and 70 g/l of sodium sulfate, 5 g/l of sodium carbonate and 2 g/l of 44.8% strength aqueous sodium hydroxide solution. The material is dyed for 60 minutes at 80° C., and then subjected to a cold wash for 10 minutes, 2 boiled washes for 10 minutes each and then a wash at 60° C. for 10 minutes, with overflow.

The cotton tricot is then divided into 3 parts:

(a) One part of the dyed cotton tricot is dried and subjected to the plating test.

(b) The second part of the dyed cotton tricot is after-treated for 10 minutes at the boil with an aqueous solution which contains 2% of condensate 2 (27.8% strength) and has a pH of about 7.

(c) The third part of the dyed cotton tricot is after-treated for 10 minutes at the boil, as described in German Laid-Open Application DOS No. 2,747,358, with a solution which contains 2% of the condensate obtained from 1 mole of methyldipropylenetriamine and 0.87 mole of epichlorohydrin (27.8% strength) and has a pH of about 7.

The plating test shows that the untreated cotton tricot (sample a) bled to a pronounced extent onto the undyed fabric. Although it is possible to reduce bleeding by means of treatment (c), it is not prevented. This is achieved only by treatment (b).

EXAMPLE 8

In a fully flooded jet dyeing apparatus, 100 kg of cotton fabric are dyed in 1,500 l of dye liquor which contains 5 kg of the orange reactive dye of the formula

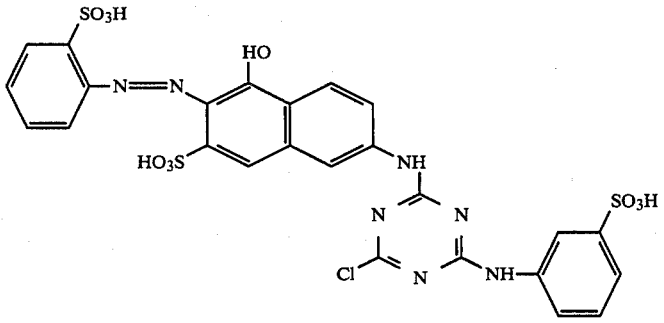

in a commercial formulation, the dyeing procedure being as follows.

The dye bath is heated to 95° C. in the course of 20 minutes. After a residence time of 10 minutes at 95° C., 30 kg of sodium chloride are added and the temperature is then kept at 95° C. for a further 5 minutes. The bath is then cooled to 80° C. in the course of 10 minutes, after which 4 kg of sodium carbonate and 2 l of 44.8% strength aqueous sodium hydroxide solution are added.

The fabric is then divided into 3 parts:

(a) One part of the fabric is dried and subjected to the plating test.

(b) The second part of the dyed cotton fabric is treated on a padding mangle with an aqueous solution containing
80 g/l of dimethylolglyoxalmonoureine (45% strength) and
12 g/l of $MgCl_2.6H_2O$.
The wet pick-up is 78%. The fabric is then dried at 110° C., after which condensation is carried out for 4 minutes at 155° C.

(c) The third part of the dyed cotton fabric is treated on a padding mangle with an aqueous solution having the following composition:
80 g/l of dimethylolglyoxalmonoureine (45% strength),
12 g/l of $MgCl_2.6H_2O$ and
40 g/l of condensate 3 (24% strength).
The wet pick-up and drying and condensation conditions described under (b) are maintained.

The plating test shows that the untreated fabric (sample a) and the fabric subjected to treatment (b) exhibit pronounced bleeding onto the undyed material. Bleeding on to the undyed fabric can be prevented only by treatment (c).

The addition of condensate 3 in treatment (c) does not have an adverse influence on the effectiveness of the wrinkle resist and shrink resist finish. The finishes according to (b) and (c) give the same shrinkage values for household linen (20 minutes at 60° C.). The Monsanto method for assessing the wrinkle recovery likewise shows no differences.

When a water repellent is additionally used in baths (b) and (c), it is furthermore found that the hydrophobic properties of the treated fabric are not influenced by the presence of condensate 3.

We claim:

1. A process for the after-treatment of dyeings with reactive dyes on cellulose fiber materials, wherein the after-treatment is carried out using an aqueous solution of a cationic condensate which is obtainable by reacting (a) bisbenzylpiperazine with (b) ethylene chloride, an epihalohydrin, propylene chloride, 1,3-dichloro-2-hydroxypropane, bisepoxybutane or 1,4-dichlorobutane or a mixture of these, in a molar ratio of from 1:0.5 to 1:1.1, or by reacting (c) piperazine, bis-1,4-aminopropylpiperazine, 1-aminoethylpiperazine, 2-hydroxyethylpiperazine or 1-methylpiperazine, or a mixture of these, with a compound according to (b) in a molar ratio of from 1:0.5 to 1:1.1 and then benzylating the condensate from (b) or (c), 0.15–1.0 mole of benzyl chloride being used per equivalent of nitrogen in component (c) for the benzylation.

2. A process as claimed in claim 1, wherein the after-treatment agent is used in an amount of from 0.1 to 5% by weight, based on the cellulose fiber materials.

3. A process as claimed in claim 1, wherein the after-treatment is carried out using an aqueous solution at from 5° to 120° C. and at a pH of from 4 to 11.

4. A process as claimed in claim 1, wherein the cationic condensate used is a benzylated piperazine/epichlorohydrin condensate.

* * * * *